United States Patent [19]

Masuda et al.

[11] 4,062,150

[45] Dec. 13, 1977

[54] CENTERLESS GRINDING METHOD AND DEVICE USING SAME

[75] Inventors: Masami Masuda; Syuhei Takasu, both of Yokohama, Japan

[73] Assignee: Hitachi, Ltd., Japan

[21] Appl. No.: 721,236

[22] Filed: Sept. 8, 1976

[30] Foreign Application Priority Data

| | | |
|---|---|---|
| Sept. 10, 1975 | Japan | 50-108990 |
| Feb. 25, 1976 | Japan | 51-19008 |

[51] Int. Cl.[2] ..... B24B 5/26; B24B 1/00

[52] U.S. Cl. ..... 51/5 D; 51/103 R; 51/289 R

[58] Field of Search ..... 51/5 D, 103 R, 103 TF, 51/281 R, 289 R

[56] References Cited

U.S. PATENT DOCUMENTS

| | | | |
|---|---|---|---|
| 1,924,593 | 8/1933 | Binns | 51/103 R |
| 2,425,897 | 8/1947 | Peterson | 51/103 TF |
| 2,501,389 | 3/1950 | Hopkins | 51/103 TF X |
| 2,624,159 | 1/1953 | Balsiger | 51/103 TF |
| 3,025,644 | 3/1962 | Hogarth | 51/103 TF |
| 3,127,716 | 4/1964 | Peters | 51/103 R X |
| 3,132,454 | 5/1964 | Balsiger | 51/103 R X |
| 3,155,086 | 11/1964 | Ornehage | 51/103 R X |

*Primary Examiner*—Harold D. Whitehead
*Assistant Examiner*—Nicholas P. Godici
*Attorney, Agent, or Firm*—Craig & Antonelli

[57] ABSTRACT

A centerless grinding method and a device using same, in which: a work having a cylindrical stem portion and a flange portion is supported on a supporting plate; a regulating wheel is provided with a lead angle so as to feed the work in its axial direction; the regulating wheel is fed in the direction substantially perpendicular to the axis of the grinding wheel, with the axis of the regulating wheel being inclined in a manner the peripheral surface of the regulating wheel may be maintained in parallel with a given conical peripheral surface of the grinding wheel which has a square or right-angled edge in its cross section; and the aforesaid grinding wheel has peripheral surfaces consisting of two continuous frusto-conical surfaces; whereby the stem portion and an inner face of the flange portion of the work may be ground at the same time.

21 Claims, 7 Drawing Figures

CENTERLESS GRINDING METHOD AND DEVICE USING SAME

BACKGROUND OF THE INVENTION

This invention relates to a centerless grinding method and a device using the same.

In general, when a cylindrical stem portion and an inner face of a flange portion of a work are ground in a centerless grinder at a time, such a portion of a grinding wheel, which is to grind the inner face of a flange portion of a work causes wear in the axial direction of the grinding wheel. To cope with this, a wear amount of the grinding wheel should be compensated for in an attempt to insure desired positional accuracy of the inner face of the flange portion. To this end, there is provided a grinding-wheel shaft adapted to shift the grinding wheel in its axial direction in a centerless grinder. However, a prior art centerless grinder dictates the use of a complicated grinding-wheel shaft and a mechanism for controlling or compensating a wear amount. In addition, a grinding amount of the inner face of a flange portion of a work can not be so increased, and the rigidity of a grinding-wheel shaft is lowered.

SUMMARY OF THE INVENTION

It is a principal object of the present invention to provide a centerless grinding method and a device using same, which may improve the rigidity of a grinding-wheel shaft, without shifting a grinding wheel in an axial direction, for the purpose of compensating wear of the grinding wheel, and which allows an increase in a grinding amount of an inner face of a flange portion of a work to some extent, whereby the stem portion and the inner face of the flange portion of a work may be ground at the same time.

It is another object of the present invention to provide a centerless grinding method and a device using same, in which there is provided a compensating mechanism for compensating wear of a grinding wheel, which mechanism is simple in construction, while allowing simultaneous grinding of a stem portion and an inner face of a flange portion of a work.

According to the present invention, there are provided a centerless grinding method and a device using same, in which: a work is supported on a supporting plate and a regulating wheel is provided with a lead angle so as to feed the work in an axial direction thereof; an axis of the regulating wheel is inclined in a horizontal plane so as to maintain the outer peripheral surface of the regulating wheel in parallel with a given conical surface of the grinding wheel having outer peripheral surfaces consisting of at least two frusto- conical surfaces which are continuous with each other; and the regulating wheel is fed in the direction substantially perpendicular to the axis of the grinding wheel, thereby grinding a stem portion and the inner face of a flange portion of a work at the same time.

According to another aspect of the present invention, there is provided a centerless grinding device in which: there is provided a grinding wheel whose peripheral surfaces consist of at least two continuous frusto- conical surfaces; there is provided a supporting plate adapted to support a work which is being ground by the grinding wheel; there is provided a regulating wheel having a cylindrical peripheral surface and has its axis inclined to the axis of a work at the aforesaid lead angle to the axis of the work in a vertical plane so as to feed the work in the axial direction thereof; the axis of the regulating wheel is inclined at a given angle in a horizontal plane so as to maintain its peripheral surface in parallel with a given conical surface of the grinding wheel; there is provided means for feeding the regulating wheel in one given direction with respect to the grinding wheel; whereby a stem portion and an inner face of a flange portion of a work may be ground the same time, without shifting the grinding wheel or regulating wheel in its axial direction.

DESCRIPTION OF THE PREFERRED EMBODIMENTS

Figure 1:
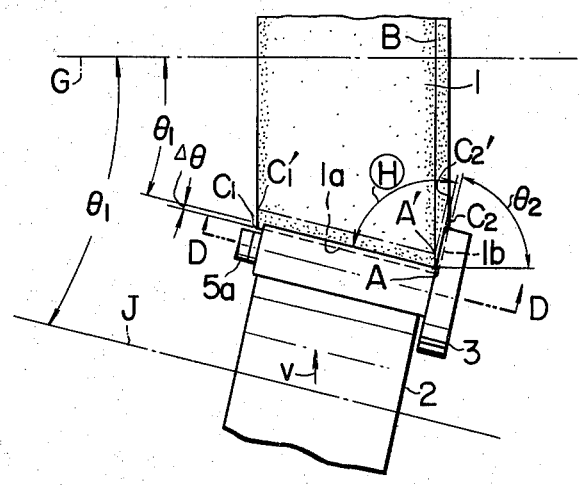
FIG. 1 is an enlarged view of an essential part of a centerless grinder according to the present invention, illustrating a principle incorporated therein.
Figure 2:
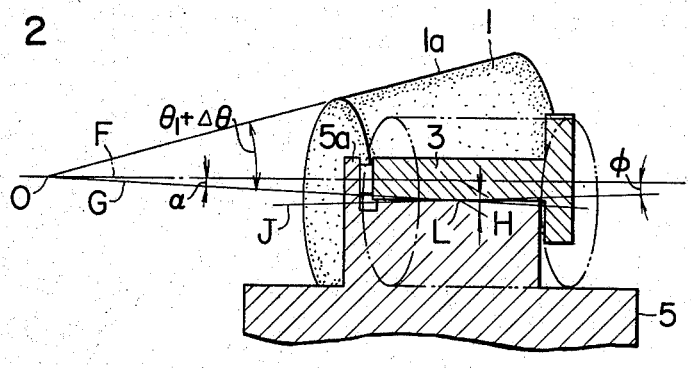
FIG. 2 is a cross-sectional view taken along the line D—D of FIG. 1.

FIGS. 1 and 2 are illustrative of a principle incorporated in the method and a device according to the present invention. FIG. 1 is a plan view of part of a centerless grinder, as viewed from the top, and FIG. 2 is a cross-sectional view taken along the line D—D of FIG. 1. An axis J of a regulating wheel 2 is inclined at an angle $\theta 1$ to an axis G of a grinding wheel 1 in a horizontal plane, as shown in FIG. 1. A working surface $C_1$,A of the grinding wheel 1 is disposed in parallel with the axis J of the regulating wheel 2. In addition a working surface $C_2$,A of the grinding wheel is so designed that an angle $\angle C_1,A,C_2$ may coincide with a design angle Ⓗ made by a stem portion and an inner face of a flange portion of a work 3. On the other hand, the regulating wheel 2 is formed with a peripheral surface free of a tapered surface but substantially parallel with the axis J of the wheel 2 itself. However, a lead angle $\phi$, i.e., an angle made by the axis F of the work 3 and the axis J of the regulating wheel in the vertical plane as shown in FIG. 2 is provided for the axis of the regulating wheel 2. In other words, in cross-sectional view of FIG. 2, a height or distance from the axis F of the work 3 on the side of the flange portion of the work 3 to the axis J of the wheel 2 is so designed as to be smaller than a height or distance from the axis F of the work 3 on the other side opposite the flange portion of the work 3 to the axis J thereof, in an attempt to allow the grinding wheel 1 to grind the inner face of the flange portion of the work 2 in its axial direction as well as to insure dimensional accuracy for the inner face of the flange portion of the work 3 with the aid of a stopper 5*a* mounted to one end of a supporting plate 5, with one end of the work 3 being designed so as to abut the stopper 5*a*. Meanwhile, as shown in FIG. 2, a distance from the axis F of the work 3 to a point L, at which the axis G of the grinding wheel 1 and the axis J of the regulating wheel 2 intersect with each other in their projected vertical plane is termed as a height of axis H of the work 3. The height H is set to an optimum value for insuring a desired "out-of - roundness" for a work. Meanwhile, even if the axis F of the work 3 is placed in parallel with a horizontal plane including the axis G of the grinding wheel 1, an angle Ⓗ made by the axis F of the work 3 and an inner face of the flange portion of the work 3 will not coincide with a design angle Ⓗ + ΔⒽ (see FIG. 4) of the grinding wheel 1. For this reason, as shown in FIG. 2, it is mandatory that the top surface of the supporting plate 5 be inclined at an angle $\alpha$ to the axis G of the grinding wheel 1 in the counterclockwise direction in a vertical plane so as to allow the axis F of the work 3 to pass through a vertex O of a conical surface 1*a*, i.e., a grinding surface of the grinding wheel 1 for the stem portion of the work 3. Stated differently, the axis G of the grinding wheel 1 should be inclined at an angle ($\alpha + \phi$) to the axis J of the regulating wheel 2. More specifically, since the axis F of the work 3 is supported by the supporting plate 5 at an inclined angle $\alpha$ to the axis G of the grinding wheel 1, half a vertex angle of the grinding wheel 1 should be increased by an angle $\Delta\theta$, as compared with an angle $\theta 1$ made by an axis of the grinding wheel 1 and an axis of the regulating wheel 2. Still stated otherwise, half a vertex angle of the wheel 1 should be $\theta 1 + \Delta\theta$, as shown in FIG. 2. Meanwhile, the regulating wheel 2 is inclined at a lead angle to the work 3, so that the peripheral surface of the regulating wheel 2 is formed with a slightly concave surface in the axial direction, so that the peripheral surface of the regulating wheel 2 and the peripheral surface of the work 3 may provide a line contact.

Figure 3:
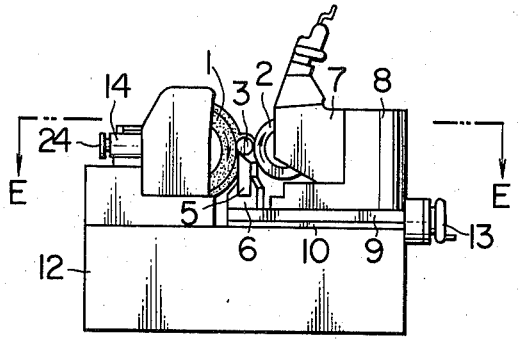
FIG. 3 is a side view showing one embodiment of a centerless grinder according to the present invention.
Figure 4:
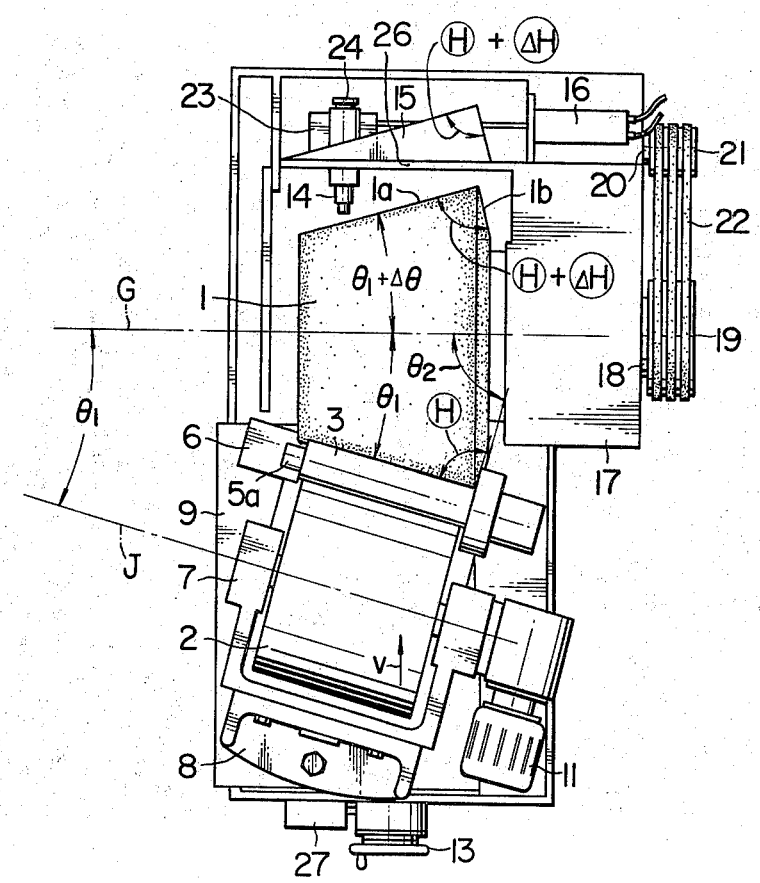
FIG. 4 is a cross-sectional view taken along the line E—E of FIG. 1.

One embodiment of the centerless grinder will be described in more detail with reference to FIGS. 3 and 4, which grinder is based on the aforesaid principle of the invention. Shown at 1 is a grinding wheel which is formed with a conical surface 1*a* inclined at an angle ($\theta 1 + \Delta\theta$) to the axis G thereof and a conical surface 1*b* inclined at an angle $\theta 2$ to the axis G as well as at an angle Ⓗ + ΔⒽ to the conical surface 1*a*. The grinding wheel 1 is rotatably supported by a grinding-wheel-shaft head 17 mounted on a bed 12. Shown at 19 is a pulley secured on one end of a shaft 18 securing the grinding wheel 1 at the other end. The pulley 19 is coupled by the medium of a belt 22 to a pulley 21 secured on an output shaft 20 of a drive motor, and is adapted to rotate in a clockwise direction as shown in FIG. 3. Shown at 2 is a regulating wheel having a cylindrical peripheral surface having a substantially uniform radius with respect to the axis thereof, and the regulating wheel 2 is rotatably supported in bearings 7 positioned on the opposite sides of the regulating wheel 8. In addition, the regulating wheel 2 is so designed as to rotate in a clockwise direction as shown in FIG. 3 with the aid of a drive motor 11. The bearings 7 are angularly adjustable in the vertical plane, so that the axis J of the regulating wheel 2 may be inclined at an angle ($\alpha + \phi$) to the axis G of the grinding wheel in the vertical plane. Shown at 10 is a first slider. A second slider 9 is so positioned that the second slider 9 is turned through the aforesaid inclined angle $\theta_1$ about a pivot (not shown), for the purpose that the axis J of the regulating wheel 2 may be inclined at an angle $\theta_1$ to the axis G of the grinding wheel 1 in the horizontal plane. In addition, the first slider 10 is supported on the bed 12 in a manner to be slidable in the direction perpendicular to the axis G of the grinding wheel 1, and adapted to be fed by means of a feeding screw mechanism (not shown) coupled to a drive means 27 and a feeding handle 13, with a drive means 27 being connected to an NC device. Shown at 14 is a dresser adapted to tailor the contour of the grinding wheel 1 to a given configuration. The dresser head 23 is coupled to a piston rod of a hydraulic cylinder 16 and supports the dresser 14 in a sliding relation in the direction at a right angle to the axis of the grinding wheel 1, the aforesaid dresser head 23 being adapted to be shifted in the axis direction of the grinding wheel 1 by hydraulic cylinder 16. The dresser 14 is adapted to follow a profiling surface of a triangular template 15 being secured to a frame 26 mounted on the bed 12 and having a vertex angle equal to the angle Ⓗ + ΔⒽ made by the conical surface 1*a* and conical surface 1*b* of the grinding wheel 1. Shown at 5 is a supporting plate adapted to support a stem portion of the work 3. The supporting plate 5 is formed with a top surface which is in parallel with a line F and inclined at an angle $\alpha$ to the horizontal plane and spaced from the line F by a radius of the stem portion of the work 3, the aforesaid line F being the axis of the work 3 and passing through a vertex of the conical surface 1*a* of the grinding wheel 1, and having a height of axis H or distance, as measured from an intersecting point L of the axis G of the grinding wheel 1 and the axis J of the regulating wheel 2 in their projected vertical plane, to the axis F of the work 3. In addition, the supporting plate 5 is provided with a stopper 5*a* mounted adjustably therein and spaced from the intersecting point A of the conical surfaces of the grinding wheel 1 by a given distance equal to the length of a the stem of a work. The stopper 5*a* may be advanced or retracted in the axial direction of the work 3. Still furthermore, the supporting plate 5 is adjustable in the vertical plane relative to a supporting base 6 which is rigidly mounted on the second slider 9. In operation, when the feed handle 13 is rotated by a given number of turns so as to feed the regulating wheel 2 in the feed direction *v*, then the stem portion of the work 3 is ground by means of the grinding wheel 1, whereupon there is developed a thrust on the surface of the grinding wheel due to the lead angle $\phi$ of the regulating wheel 2, so that the work 3 is biased towards the stopper 5*a*, so that the inner face of the flange portion of the work may be ground by the grinding wheel. In the initial stage of a grinding cycle, the work 3 is spaced a distance from the stopper 5*a*, so that the aforesaid thrust is brought into equilibrium with a normal component of a grinding force on the inner face of the flange portion. However, the thrust is considerably large, so that there results an accelerated grinding rate for the inner face of the flange portion of the work, presenting a rough ground surface. However, after the work 3 has abutted the stopper 5*a*, a grinding rate of the inner face of the flange portion is decreased as compared with a grinding rate of the stem portion of the work, thus presenting medium finishing and thereafter precision-finishing, so that a grinding action on the inner face of the flange portion exerts minimum influence on grinding accuracy of the stem portion of the work, presenting desired grinding accuracy.

In case a grinding wheel causes wear, then a working surface of the grinding wheel is dressed from lines $C_1$,A,$C_2$ to lines $C'_1$, A',$C'_2$ as shown in FIG. 1 in parallel relation thereto, by means of the dresser 14 having a reference or base line on the surface of the template 15, with the result that a corner A of the grinding wheel 1 remains positioned in the feed direction *v* of the work, i.e., on a line AB at a right angle to the axis G of the grinding wheel 1. Accordingly, compensation for wear of the peripheral surface of the grinding wheel 1 may be achieved only by shifting the dresser 14 in the feed direction *v* of a work to an extent or distance corresponding to a decrease in radius of the grinding wheel due to rotation of a feeding screw for the dresser 14 mounted on the dresser head 23 so as to feed same in its advancing direction. As a result, unlike the prior art, in which the grinding wheel 1 or the regulating wheel 2 is moved in the axial direction, the compensating means according to the present invention is simple in construction and dispenses with a complicated mechanism for compensating wear of the grinding wheel.

Figure 5:
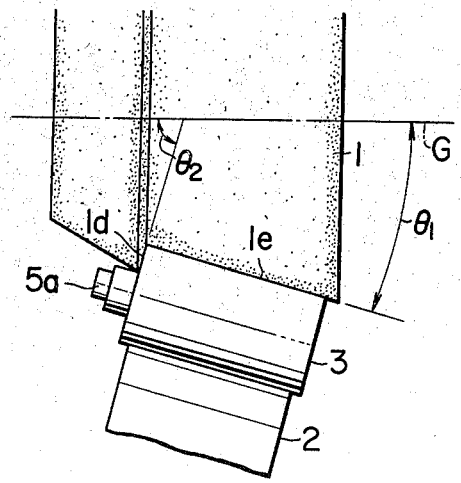
FIG. 5 is an enlarged plan view of an essential part of another embodiment of the centerless grinder according to the invention.
Figure 6:
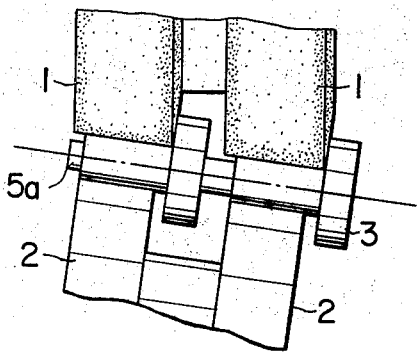
FIG. 6 is an enlarged plan view of a still another embodiment of the centerless grinder according to the present invention.

While description has been given of an instance where an angle Ⓗ made by the stem portion of the work and the inner face of the flange portion of the work is a right angle, the present invention is by no means limited to this instance, and the aforesaid angle may be larger or smaller than a right angle. Alternatively, as shown in FIG. 5 the contour of grinding wheel 1 may be formed of a conical surface 1*e* which is inclined at an angle $\theta 1$ to the axis G thereof and a conical surface 1*d* which is continuous with but projecting radially outwards from an edge of the conical surface 1*e* of the grinding wheel 1 on the side of a smaller diameter of the wheel 1, the aforesaid conical surface 1*d* being inclined at an angle $\theta 2$ to the axis G of the grinding wheel 1, while the other portions of the grinding device remain the same as those of the embodiments shown in FIGS. 1 and 2. Then, a stem portion and an inner face of a flange portion of a work may be ground at the same time according to the centerless grinder of the invention, achieving the same result as that obtained from the foregoing embodiment. In addition, as shown in FIG. 6 in case two flange portions are provided for the work 3, it suffices that two grinding wheels and regulating wheels 2 as shown in FIGS. 1 and 2 are provided, respectively.

Figure 7:
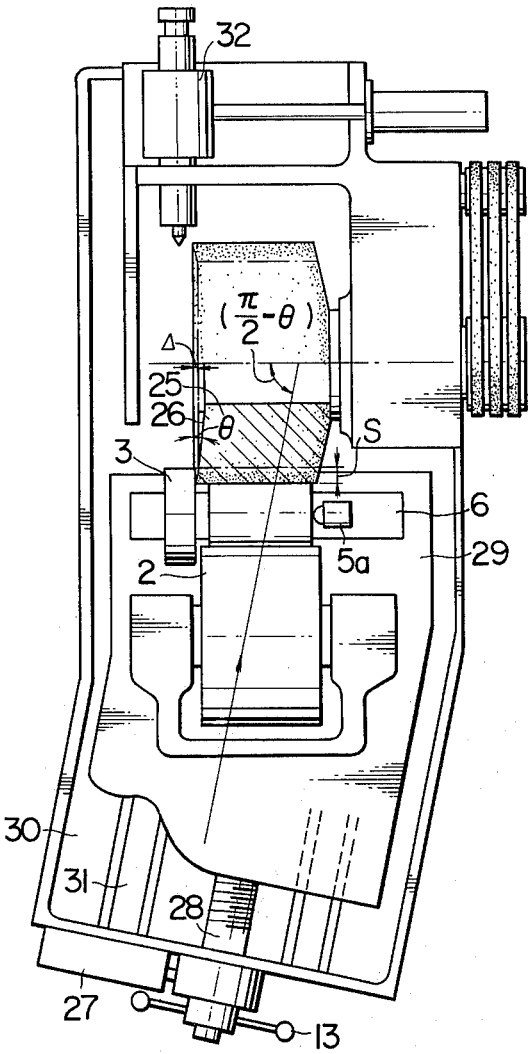
FIG. 7 is a plan view of a yet another embodiment of the centerless grinder according to the invention.

In addition, in case an inner face of a flange portion of the work 3 should not necessarily be subjected to finishing grinding, rather than grinding to a considerable amount, the stem portion as well as the inner face of the flange portion of a work may be centerless- ground in the same manner as in the embodiment of FIG. 7.

As shown in FIG. 7, a grinding wheel 25 is formed with a concave, working side-surface 26 (relief surface or base line) which is inclined at an angle $\theta$ to a plane perpendicular to the axis of the grinding wheel. The work 3 is supported on the work-supporting base 6 in a manner that a flange portion of the work 3 is positioned on the side of the relief surface of the grinding wheel and that the peripheral surface of the grinding wheel 25 is positioned in parallel with the axis of the work 3. When a lead screw 28 is rotated by means of a lead-screw-drive means 27, then a regulating wheel base 29 coupled thereto will slide along a guide 31 on a bed 30 which is inclined at an angle $(\pi/2 - \theta)$ to the axis of the grinding wheel 25, while the work 3 is fed to the side of a grinding wheel to be ground. In this respect, the axis of the regulating wheel 2 is inclined at a minute lead angle to the axis of the grinding wheel 25 in the vertical plane, so that the work 3 will be fed towards the stopper 5*a* positioned opposite the flange portion of the work 2, with the result that the inner face of the flange portion of the work may be ground with the side surface of the grinding wheel. Meanwhile, a plurality of repeated cycle of grinding results in wear of the side surface of the grinding wheel. The aforesaid wear of the side surface of the grinding wheel leads to an error in dimension covering from the end face of the stopper 5*a* to the inner face of the flange portion of the work. Thus, such an error should be compensated for. Assume that, as shown in FIG. 7, the side surface of the grinding wheel causes wear ($\Delta$) from a solid line to a one point chain line. When a cylindrical portion of the grinding wheel 25 is radially dressed an extent $S = \Delta/\tan\theta$ means of the dresser 32, then the periphery of the grinding wheel may be decreased in diameter. Then, when the regulating wheel base 29 is shifted a distance corresponding to a decrease S in radius of the grinding wheel, by means of the regulating-wheel-feed handle 13, then the stopper 5*a* mounted on the work supporting base 6 on the regulating wheel base 29 is moved backwards a distance ($\Delta$) in the axial direction of the grinding wheel, with the result that a distance between a shoulder portion of the grinding wheel 25 and the stopper 5*a* may be maintained constant, permitting desired compensation for wear. In addition, the regulating-wheel base 29 rotatably supports the regulating wheel 2, and allows the stopper 5*a* to move in the axial direction of the work 3 for positional adjustment, and in addition, the regulating-wheel base 29 mounts the supporting base 6 thereon. Meanwhile, in the aforesaid embodiment, description has been given of the case where the regulating-wheel base 29 is inclined at an angle $(\pi/2 - \theta)$ to the axis of the grinding wheel. Alternatively, the regulating-wheel base is secured to the bed, while a guide may be provided in the bed 30 in a manner that a grinding-wheel base supporting the grinding wheel 25 rotatably, may be moved in parallel with the base line 26. This may achieve the same result as that of the aforesaid embodiment.

As is apparent from the foregoing description, a stem portion and an inner face of a flange portion of a work may be ground to given dimensions at a time, only by varying a feed amount of a regulating wheel, without shifting a grinding wheel in its axial direction relative to a stopper on a supporting plate which governs the position of a work. In addition, according to the present invention, the number of grains contained in a grinding wheel associated with the grinding of the inner face of a work may be increased to a considerable extent, so that a service life of a portion of a grinding wheel, which is to grind the inner face of the flange portion of a work, may be used for an extended period of time. This permits an increased grinding amount for the inner face of a flange portion of a work. In addition, according to the present invention, the regulating wheel may be formed into a substantially cylindrical form, so that there may be achieved a uniform peripheral speed of a work, with the resulting accurate "out- of -roundness" of a stem portion of a work.

What is claimed is:

1. A centerless grinding device for grinding surfaces of a workpiece comprising:

a grinding wheel with first and second working surfaces, supporting means for supporting the workpiece with first and second workpiece surfaces which respectively contact with the first and second working surfaces of the grinding wheel during grinding operations, said workpiece surfaces being angularly disposed with respect to one another, said second working surface being angularly disposed with respect to said first working surface and being configured to limit workpiece movement in an axial direction during grinding operations, a regulating wheel with a peripheral surface which contacts with the first workpiece surface, said regulating wheel having its axis inclined at a lead angle to the axis of the workpiece in the vertical plane so as to force the workpiece in the axial direction of the workpiece relative to the grinding wheel and thereby to cause the contact of the second workpiece surface with the second surface of the grinding wheel upon movement of the regulating wheel in a predetermined direction toward said first workpiece surface, and feeding means for feeding the regulating wheel in a predetermined direction so as to grind the first and second workpiece surfaces.

2. A centerless grinding device according to claim 1, wherein said second working surface is shaped as a frusto-conical surface which is coaxial to the rotational axis of the grinding wheel.

3. A centerless grinding device according to claim 1, further comprising a stopper member positioned at one end of the workpiece for limiting the axial movement of the workpiece and thereby the amount of grinding to be effected on said second workpiece surface.

4. A centerless grinding device according to claim 1, wherein the first and second working surfaces are axially connected frusto-conical working surfaces.

5. A centerless grinding device according to claim 4, wherein the means for supporting the workpiece includes a plate disposed at an inclined angle to the axis of the grinding wheel.

6. A centerless grinding device according to claim 3, wherein the first and second working surfaces are axially connected frusto-conical working surfaces.

7. A centerless grinding device according to claim 4, wherein the first working surface of the grinding wheel is a frusto-conical surface which is inclined to the axis of the grinding wheel and the second working surface is a second frusto-conical surface which is continuous with and projects radially outwards from an edge of said first frusto-conical surface.

8. A centerless grinding device according to claim 1, further comprising:

a second grinding wheel connected to the first-mentioned grinding wheel and having third and fourth working surfaces which contact with respective third and fourth workpiece surfaces of the workpiece, and a second regulating wheel connected to the first-mentioned regulating wheel and having a peripheral surface which contacts with the third workpiece surface, the axis of the second regulating wheel being inclined in the vertical plane with respect to the axis of the workpiece in the vertical plane.

9. A centerless grinding device according to claim 1, wherein the second working surface of the grinding wheel is concave.

10. A centerless grinding device according to claim 4, wherein the first working surface of the grinding wheel is positioned in parallel with the axis of the workpiece and the second working surface of the grinding wheel is inclined to a plane perpendicular to the axis of the grinding wheel.

11. Apparatus according to claim 10, wherein the means for supporting the workpiece includes a plate disposed at an inclined angle to the axis of the grinding wheel.

12. A centerless grinding device according to claim 9, wherein the first working surface of the grinding wheel is positioned in parallel with the axis of the workpiece and the second working surface of the grinding wheel is inclined to a plane perpendicular to the axis of the grinding wheel.

13. A centerless grinding device according to claim 4, wherein the means for feeding the regulating wheel feeds the regulating wheel in a direction perpendicular to the axis of the grinding wheel.

14. Apparatus according to claim 4, further comprising means for dressing the grinding wheel so as to bring its shape into agreement with sloped surfaces of a template located at a given position relative to the grinding wheel, wherein the sloped surfaces correspond to the respective frusto-conical working surfaces.

15. A centerless grinding device according to claim 14, further comprising a stopper member positioned at one end of the workpiece for limiting the axial movement of the workpiece and thereby the amount of grinding to be effected on said second workpiece surface.

16. A centerless grinding device according to claim 1, wherein said predetermined direction is perpendicular to the axis of rotation of said grinding wheel.

17. A centerless grinding device according to claim 4, further comprising a stopper mounted on a regulating wheelbase rotatably supporting said regulating wheel, said stopper being adapted to determine the amount of grinding to be effected on said second workpiece surface, said second workpiece surface constituting an inner surface of a flange portion of said workpiece.

18. A centerless grinding device according to claim 4, wherein said means for supporting said workpiece includes a supporting plate having a supporting surface inclined in a manner to be commensurate with the distance between the axis of the workpiece and the intersection of the axes of the grinding wheel and the regulating wheel in a projected vertical plane, with the axis of the workpiece passing through a vertex of a given conical working surface of said grinding wheel in said vertical plane.

19. A centerless grinding device according to claim 4, wherein the peripheral surface of said regulating wheel is formed as a slightly concaved surface for bringing the workpiece into line contact with the regulating wheel when the axis of the regulating wheel is inclined at a lead angle in a horizontal plane.

20. A centerless grinding method for grinding surfaces of a workpiece comprising the steps of:

supporting the workpiece between a grinding wheel and a regulating wheel, simultaneously grinding a first workpiece surface of the workpiece with a first working surface of the grinding wheel and a second workpiece surface of the workpiece with a second working surface of the grinding wheel with said second working surface being angularly disposed with respect to said first working surface and being configured to limit workpiece movement in an axial direction during grinding operations, and moving the regulating wheel in a predetermined linear direction to force said workpiece against the grinding wheel during said grinding with said regulating wheel inclined in the vertical plane so as to exert a component of force with respect to the axis of the workpiece on said workpiece which forces said workpiece in a direction at an angle to said linear direction, whereby the simultaneous grinding of said first and second workpiece surfaces is accommodated for without requiring movement of said regulating wheel in other than said predetermined linear direction.

21. A method according to claim 20, wherein said first and second working surfaces on the grinding wheel are frusto-conical, and wherein said predetermined linear direction is perpendicular to the axis of rotation of the grinding wheel.

* * * * *